US006174637B1

(12) United States Patent
Carmichael et al.

(10) Patent No.: US 6,174,637 B1
(45) Date of Patent: Jan. 16, 2001

(54) ELECTROPHOTOGRAPHIC IMAGING MEMBER AND PROCESS OF MAKING

(75) Inventors: Kathleen M. Carmichael, Williamson; Satish R. Parikh, Rochester, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/488,407

(22) Filed: Jan. 19, 2000

(51) Int. Cl.[7] ..... G03G 5/04
(52) U.S. Cl. ..... 430/59.1; 430/96; 430/134
(58) Field of Search ..... 430/59.1, 96, 134

(56) References Cited

U.S. PATENT DOCUMENTS

| | | | | |
|---|---|---|---|---|
| Re. 33,724 | | 10/1991 | Takei et al. | 430/96 |
| 3,357,989 | | 12/1967 | Byrne et al. | 430/78 |
| 3,442,781 | | 5/1969 | Weinberger | 114/125 |
| 3,898,084 | | 8/1975 | Champ et al. | 430/71 |
| 3,899,329 | | 8/1975 | Bean et al. | 430/76 |
| 4,232,103 | | 11/1980 | Limburg et al. | 430/58.8 |
| 4,251,612 | | 2/1981 | Chu et al. | 430/60 |
| 4,265,990 | | 5/1981 | Stolka et al. | 430/96 |
| 4,286,033 | | 8/1981 | Neyhart et al. | 430/60 |
| 4,291,110 | | 9/1981 | Lee | 430/60 |
| 4,293,628 | | 10/1981 | Hashimoto et al. | 430/72 |
| 4,299,896 | | 11/1981 | Hashimoto et al. | 430/72 |
| 4,309,611 | | 1/1982 | Tanaka et al. | 250/366 |
| 4,314,015 | | 2/1982 | Hashimoto et al. | 430/73 |
| 4,327,168 | | 4/1982 | Hashimoto | 430/72 |
| 4,338,387 | | 7/1982 | Hewitt | 430/85 |
| 4,359,513 | | 11/1982 | Katagiri et al. | 430/72 |
| 4,390,608 | | 6/1983 | Hashimoto et al. | 430/72 |
| 4,390,611 | | 6/1983 | Ishikawa et al. | 430/72 |
| 4,400,455 | | 8/1983 | Hashimoto et al. | 430/76 |
| 4,415,639 | | 11/1983 | Horgan | 430/64 |
| 4,418,133 | | 11/1983 | Katagiri et al. | 430/77 |
| 4,427,753 | | 1/1984 | Fujimura et al. | 430/70 |
| 4,440,845 | | 4/1984 | Hashimoto | 430/72 |
| 4,486,519 | | 12/1984 | Sasaki | 430/73 |
| 4,486,522 | | 12/1984 | Hashimoto | 430/79 |
| 4,486,800 | | 12/1984 | Franksen | 361/19 |
| 4,495,264 | | 1/1985 | Takahashi et al. | 430/72 |
| 4,551,404 | | 11/1985 | Hiro et al. | 430/72 |
| 4,555,667 | | 11/1985 | Cressey et al. | 329/50 |
| 4,820,602 | | 4/1989 | Matsumoto | 430/72 |
| 4,830,944 | | 5/1989 | Umehara et al. | 430/73 |
| 5,164,276 | | 11/1992 | Robinson et al. | 430/83 |
| 5,213,924 | * | 5/1993 | Sakamoto | 430/96 |
| 5,437,950 | | 8/1995 | Yu et al. | 430/83 |
| 5,521,047 | | 5/1996 | Yuh et al. | 430/134 |
| 5,554,473 | | 9/1996 | Cais et al. | 430/96 |
| 5,578,406 | * | 11/1996 | Ojima et al. | 430/96 |
| 5,709,974 | | 1/1998 | Yuh et al. | 430/66 |
| 5,863,686 | | 1/1999 | Yuh et al. | 430/83 |
| 5,891,594 | | 4/1999 | Yuh et al. | 430/71 |
| 5,922,498 | | 7/1999 | Yuh et al. | 430/60 |

* cited by examiner

*Primary Examiner*—Roland Martin
(74) *Attorney, Agent, or Firm*—Oliff & Berridge, PLC

(57) ABSTRACT

A photo conducting imaging member has a charge generator layer including a binder containing at least a polycarbonate of formula (I):

(I)

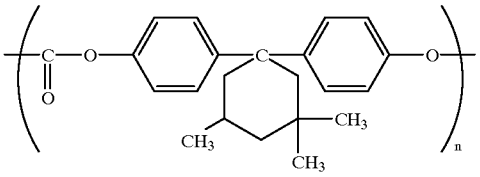

18 Claims, No Drawings

ELECTROPHOTOGRAPHIC IMAGING MEMBER AND PROCESS OF MAKING

BACKGROUND OF THE INVENTION

1. Field of Invention

This invention is generally directed to imaging members for electrophotography. More specifically, this invention is directed to a process for preparing a charge generator layer for electrophotographic imaging members, and to electrophotographic imaging members produced thereby.

2. Description of Related Art

In electrophotography, an electrophotographic substrate containing a photoconductive insulating layer on a conductive layer is imaged by first uniformly electrostatically charging the surface. The plate is then exposed to a pattern of activating electromagnetic radiation, such as light. The light or other electromagnetic radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This image developing can be repeated as many times as necessary with reusable photoconductive insulating layers.

An electrophotographic imaging member may take one of many different forms. For example, layered photoresponsive imaging members are known in the art. U.S. Pat. No. 4,265,990, which is incorporated herein by reference in its entirety, describes a layered photoreceptor having separate photogenerating and charge transport layers. The photogenerating layer is capable of photogenerating holes and injecting the photogenerated holes into the charge transport layer. Thus, in photoreceptors of this type, the photogenerating material generates electrons and holes when subjected to light.

More advanced photoconductive photoreceptors contain highly specialized component layers. For example, a multilayered photoreceptor that can be employed in electrophotographic imaging systems can include one or more of a substrate, an undercoating layer, an optional hole or charge blocking layer, a charge generating layer (including photogenerating material in a binder) over the undercoating and/or blocking layer, and a charge transport layer (including charge transport material in a binder). Additional layers such as an overcoating layer or layers can also be included.

The photogenerating layer utilized in multilayered photoreceptors typically include, for example, inorganic photoconductive particles or organic photoconductive particles dispersed in a film forming polymeric binder. Inorganic or organic photoconductive material may be formed as a continuous, homogeneous photogenerating layer.

In photoreceptors of the above type, the photogenerating material generates electrons and holes when subjected to light. In the case of a photoreceptor including a hole blocking layer, the blocking layer prevents holes in the conductive ground plane from passing into the generator from which they would be conducted to the photoreceptor surface, thus erasing any latent image formed thereon. The hole blocking layer does permit electrons generated in the generator to pass to the conductive ground plane, preventing an undesirably high electric field to build up across the generator upon cycling the photoreceptor.

Certain layered imaging members are known, including those comprised of separate charge generating layers, and charge transport layers and overcoated photo responsive materials containing a hole injecting layer overcoated with a hole transfer layer, followed by an overcoating of a photo generating layer; and a top coating of an insulating organic resin. Such imaging member designs are described, for example, in U.S. Pat. Nos. 4,265,990 and 4,251,612, the disclosures of which are totally incorporated herein by reference. Examples of photo generating layers disclosed in these patents include trigonal selenium and phthalocyanines, while examples of transport layers include certain aryl diamines as mentioned therein.

Additional references illustrating layered organic electrophotographic photo conductor elements with azo, bisazo, and related compounds include U.S. Pat. Nos. 4,390,611, 4,551,404, 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944 and 4,820,602, the disclosures of which are totally incorporated herein by reference.

One conventional charge generating layer binder widely used in the art is PCz, a z-form polycarbonate produced by Mitsubishi Chemical Corporation, and having the following structure:

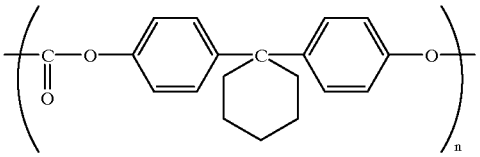

PCz is a Bisphenol-z type polycarbonate. These polycarbonates were chosen because they had the necessary properties for photoreceptor use, and also because they were soluble in non-halogenated solvents.

U.S. Reissue Pat. No. Re 33,724, the entire disclosure of which is incorporated herein by reference, discloses "z" polycarbonates containing an unsubstituted or substituted carbon ring. These polycarbonates are useful as binder materials for forming charge generating or charge transport layers of a photoreceptor.

U.S. Pat. No. 5,554,473, which is totally incorporated herein by reference, discloses a charge transport layer binder that is stated to provide wear resistance. The binder used in this patent requires a Tg of less than 200° C., since a higher temperature causes stress cracks on the charge transport layer surface.

Despite these various known designs for photoreceptors, a need continues to exist in the art for photoreceptor designs that provide high quality products at lower cost. For example, although the z polycarbonates provide acceptable results for photoreceptor materials, they are comparatively expensive, thus increasing the production cost for the photoreceptor.

Furthermore, z polycarbonates introduce important constraints into photoreceptor design. For example, a wide range of molecular weights of the z polycarbonates is not generally available, thus making it more difficult to adjust such manufacturing steps as the coating process. Generally, such z polycarbonates are available only in molecular weights in the range of about 15,000 to 60,000. Furthermore, many of the z polycarbonates are not highly soluble in non-halogenated solvents. As a result, halogenated solvents must be utilized in the coating process. Such halogenated solvents, however, are becoming increasingly less desirable from the standpoint of environmental and safety concerns.

Thus, a need continues to exist in the art for improved materials that can be used as binder materials for photoreceptors. A need also exists in the art for means to reduce the manufacturing cost and environmental concerns of the manufacturing process, while still providing high quality products.

SUMMARY OF THE INVENTION

This invention provides a new binder for a charge generating layer for photoreceptors, and a method of making such photoreceptors. The function of the charge generating layer is to photogenerate charge and inject the photogenerated charge into the charge transport layer.

To perform these functions, the charge generator layer must generally have certain characteristics and properties. This layer can be made up of a suitable film-forming binder, typically a polycarbonate, and a dispersed pigment.

The binder materials used to form the charge generator layer generally also have the additional requirement of being able to be put into solutions such that they can be coated into a film. The binder also generally has the requirement of being compatible with the dispersed pigment so that the coated film contains finely divided, uniformly dispersed particles of the pigment.

In this invention, the product APEC HT, which is a polycarbonate based on a Bisphenol-A and Bisphenol-TMC copolymer, or based on a Bisphenol-TMC homopolymer, both available from Bayer AG, is used as a binder for the charge generating layer. The Bisphenol-TMC component of APEC HT has the following structure:

(I)

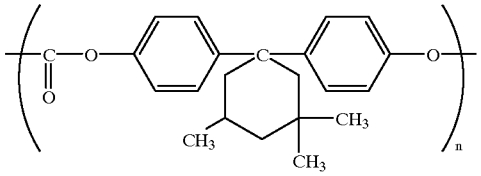

where n is from 55% to 100% in embodiments of this invention.

An increasing TMC component in the coated polycarbonate has the effect of raising the glass transition temperature and the solubility in non-halogenated solvents such as tetrahydrofuran and toluene. Thus, high TMC component percentages are particularly preferred in embodiments.

DETAILED DESCRIPTION OF PREFERRED EMBODIMENTS

A new charge generating layer includes a binder of APEC HT, which is a copolycarbonate based on Bisphenol-A and Bisphenol-TMC. The Bisphenol-TMC component of the APEC has the formula shown below:

(I)

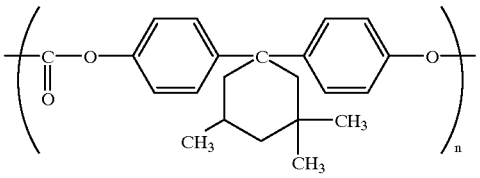

where, in embodiments of this invention, n is preferably from 55% to 100%, and more preferably from 80% to 100%, and most preferably 100%.

Thus, in embodiments of the present invention, the binder material can be a copolymer, having a bisphenol-TMC content of less than 100%, or a homopolymer, having a bisphenol-TMC content of 100%. When in copolymer form, the remaining monomeric units are preferably polycarbonate units, such as bisphenol-z units, more preferably bisphenol-A units. Terpolymers or higher order polymers can also be used, if desired.

A high TMC component percentage, such as for example, between 90% and 100%, and particularly about 100%, is preferred for use in the charge generating layer binder composition of the present invention.

The weight average molecular weight of the APEC material preferably is within the range of 35,000 to 350,000, more preferably 200,000 to 300,000, and most preferably 300,000. Of course, molecular weights outside of these ranges can be used, if desired.

One APEC material that can be used in an exemplary embodiment of this invention has a weight average molecular weight of 300,000, a viscosity (at 8.5% by weight in methylene chloride) of 323 cP at 25° C., and a Tg of 245° C. Other suitable materials include, for example, the APEC series of products, available from Bayer AG, such as APEC grades 9203 and 9204.

The APEC material is soluble in a variety of non-chlorinated solvents, thus eliminating the need to use chlorinated solvents, such as methylene chloride. Thus, in embodiments of the present invention, it is preferred that the APEC material is applied as a binder material to form the desired charge generator layer using a suitable non-halogenated solvent. For example, suitable solvents for applying the binder material include, but are not limited to, toluene, tetrahydrofuran, cyclohexane, ethyl acetate, methyl ethyl ketone, mixtures thereof, and the like. Various halogenated solvents may also be used to mix and apply the charge generator material, although such halogenated solvents are not necessary in the present invention. Such suitable halogenated solvents include, but are not limited to, methylene chloride, chlorobenzene, and the like.

The photogenerating layer may be applied to an underlying layer, such as an adhesive or blocking layer, which in turn can then be overcoated with a contiguous hole (charge) transport layer or other suitable layer. Examples of typical particles or pigments that can be included in the photogenerating layers include, but are not limited to, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine, hydroxygallium phthalocyanine, and copper phthalocyanine, dibromoanthanthrone, squarylium, quinacridones available from Dupont under the tradename Monastral Red, Monastral violet and Monastral Red Y, Vat orange 1 and Vat orange 3 trade names for dibromo anthanthrone pigments, benzimidazole perylene, perylene pigments as disclosed in U.S. Pat. No. 5,891,594, the entire disclosure of which is incorporated herein by reference, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated herein by reference. Other suitable photogenerating materials known in the art may also be utilized, if desired.

Charge generating binder layers comprising particles or layers comprising a photoconductive material such as vanadyl phthalocyanine, metal free phthalocyanine, benzimidazole perylene, amorphous selenium, trigonal selenium, selenium alloys such as seleniurn-tellurium, selenium-tellurium-arsenic, selenium arsenide, and the like and mixtures thereof are especially preferred because of their sensitivity to white light. Vanadyl phthalocyanine, metal free phthalocyanine, hydroxygallium phthalocyaning and selenium tellurium alloys are also preferred because these materials provide the additional benefit of being sensitive to infra-red light.

The photogenerating composition or pigment may be present in the resinous binder composition of this invention in various amounts. Generally, however, the photogenerating composition or pigment may be present in the resinous binder in an amount of from about 5 percent by volume to about 90 percent by volume of the photogenerating pigment dispersed in about 10 percent by volume to about 95 percent by volume of the resinous binder, and preferably from about 30 percent by volume to about 60 percent by volume of the photogenerating pigment is dispersed in about 40 percent by volume to about 70 percent by volume of the resinous binder composition. In one embodiment, about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is generally related to binder content. Thus, for example, higher binder content compositions generally require thicker layers for photogeneration. Of course, thicknesses outside these ranges can be selected providing the objectives of the present invention are achieved.

Any suitable and conventional technique may be utilized to mix and thereafter apply the photogenerating layer coating mixture. Typical application techniques include spraying, dip coating, slot coating, roll coating, wire wound rod coating, and the like. Drying of the deposited coating may be effected by any suitable conventional technique such as oven drying, infra red radiation drying, air drying and the like.

In combination with the materials for the charge generating layer in accordance with this invention, conventional materials in conventional amounts may further be included in addition to the charge generating layers. For examples, the substrate, charge transport and the other layers other than the charge generating layer of the electrophotographic imaging members of this invention can include various different conventional components and compositions and can include various different conventional characteristics and properties as may be required or desired. Examples of such other materials that can be used in the layers other than the layers in conjunction with this invention are described, for example, in U.S. Pat. Nos. 5,863,686 and 5,922,498, the disclosures of which are hereby incorporated by reference in their entirety.

Such other layers, such as conventional ground strips including, for example, conductive particles disposed in a film forming binder may be applied to one edge of the photoreceptor in contact with the conductive surface or layer, blocking layer, adhesive layer or charge generating layer.

Optionally, an overcoat layer can be utilized to improve resistance to abrasion. Also optionally, a back coating may be applied to the side opposite the imaging side of the photoreceptor to provide flatness and/or abrasion resistance. These overcoat and backcoat layers can include any suitable composition, such as, for example, organic polymers or inorganic polymers that are electrically insulating or slightly semi-conductive.

In general, electrostatographic imaging members are well known in the art. An electrostatographic imaging member, including the electrostatographic imaging member of the present invention, may be prepared by any of the various suitable techniques.

Typically, a flexible or rigid substrate is provided having an electrically conductive surface. A charge generating layer is then usually applied to the electrically conductive surface. An optional charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer may be applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including, but not limited to, polyesters, polycarbonates, polyamides, polyurethanes, mixtures thereof, and the like. As electrically conductive materials there may be employed various resins that incorporate conductive particles, including, but not limited to, resins containing an effective amount of carbon black, or metals such as copper, aluminum, nickel, and the like. The substrate can be of either a single layer design, or a multi-layer design including, for example, an electrically insulating layer having an electrically conductive layer applied thereon.

The electrically insulating or conductive substrate is preferably in the form of a rigid cylinder, drum, flexible web or belt. In the case of the substrate being in the form of a belt, the belt can be seamed or seamless, with a seamless belt being particularly preferred.

The thickness of the substrate layer depends on numerous factors, including strength and rigidity desired and economical considerations. Thus, this layer may be of substantial thickness, for example, about 5000 micrometers or more, or of minimum thickness of less than or equal to about 150 micrometers, or anywhere in between, provided there are no adverse effects on the final electrostatographic device. The surface of the substrate layer is preferably cleaned prior to coating to promote greater adhesion of the deposited coating. Cleaning may be effected by any known process including, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a photoresponsive imaging device having an electricially insulating, transparent cylinder, the thickness of the conductive layer may be between about 10 angstrom units to about 500 angstrom units, and more preferably from about 100 Angstrom units to about 200 angstrom units for an optimum combination of electrical conductivity and light transmission. The conductive layer may be an electrically conductive metal layer formed, for example, on the substrate by any suitable coating technique, such as a vacuum depositing technique. Typical metals include, but are not limited to, aluminum, zirconium, niobium, tantalum, vanadium and hafnium, titanium, nickel, stainless steel, chromium, tungsten, molybdenum, mixtures thereof, and the like. In general, a continuous metal film can be attained on a suitable substrate, e.g. a polyester web substrate such as Mylar available from E. I. du Pont de Nemours & Co., with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide generally forms on the outer surface of most metals upon exposure to air. Thus, when other layers overlying the metal layer are characterized as "contiguous" (or adjacent or adjoining) layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

After formation of an electrically conductive surface, a hole blocking layer may optionally be applied thereto for photoreceptors. Generally, electron blocking layers for positively charged photoreceptors allow holes from the imaging surface of the photoreceptor to migrate toward the conductive layer. For negatively charged photoreceptors, the blocking layer allows electrons to migrate toward the conducting layer. Any suitable blocking layer capable of forming an electronic barrier to holes between the adjacent photoconductive layer and the underlying conductive layer may be utilized. The blocking layer may include, but is not limited to, nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, $[H_2N(CH_2)_3]CH_3Si(OCH_3)_2$ (gamma-aminopropyl)methyl diethoxysilane, mixtures thereof, and the like, as disclosed in U.S. Pat. Nos. 4,291,110, 4,338,387, 4,286,033 and 4,291,110, the entire disclosures of which are incorporated herein by reference. A preferred blocking layer comprises a reaction product between a hydrolyzed silane and the oxidized surface of a metal ground plane layer. The oxidized surface inherently forms on the outer surface of most metal ground plane layers when exposed to air after deposition.

The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. In embodiments, the blocking layer thickness can be between about 0.04 microns and about 2.0 microns.

An optional adhesive layer may be applied to the hole blocking layer. Any suitable adhesive layer well known in the art may be utilized. Typical adhesive layer materials include, for example, but are not limited to, polyesters, Mor-Ester 49,000 (available Morton International Company), Vitel PE100 (available from Goodyear Tire & Rubber), polyurethanes, and the like. Satisfactory results may be achieved with adhesive layer thickness between about 0.05 micrometer (500 angstrom) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Generally, a charge generating layer is next applied to the underlying layer, such as to the underlying substrate, blocking layer or adhesive layer. According to the present invention, the above-described charge generating layer is applied.

Next, a charge transport layer is applied to the charge generating layer. Of course, as noted above, the order of the charge generating layer and the charge transport layer can be reversed, if desired, in embodiments.

The charge transport layer can comprise any suitable organic polymer or non-polymeric material capable of transporting charge to selectively discharge the surface charge. The charge transporting layer may be formed by any conventional materials and methods, such as the materials and methods disclosed in U.S. Pat. No. 5,521,047 to Yuh et al., the entire disclosure of which is incorporated herein by reference. In addition, the charge transporting layer may be formed as an aromatic diamine dissolved or molecularly dispersed in an electrically inactive polystyrene film forming binder, such as disclosed in U.S. Pat. No. 5,709,974, the entire disclosure of which is incorporated herein by reference.

Any suitable and conventional technique may be utilized to mix and thereafter apply the charge transport layer coating mixture to the charge generating layer. Typical application techniques include spraying, dip coating, roll coating, wire wound rod coating, slot coating and the like. Preferably, the coating mixture of the transport layer comprises between about 40 percent and about 70 percent by weight of the binder material, between about 30 percent and about 60 percent by weight charge transport material, based on weight of the dried layer. Drying of the deposited coating may be effected by any suitable conventional technique such as oven drying, infra-red radiation drying, air drying and the like.

Generally, the thickness of the charge transport layer is between about 10 and about 50 micrometers, for example 15–30 microns, but thicknesses outside this range can also be used. The charge transport layer should preferably be an insulator to the extent that the electrostatic charge placed on the charge transport layer is not conducted in the absence of illumination at a rate sufficient to prevent formation and retention of an electrostatic latent image thereon. In general, the ratio of thickness of the charge transport layer to the charge generator layer is preferably maintained from about 2:1 to 200:1 and in some instances as great as 400:1. In other words, the charge transport layer is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

Similarly, any suitable and conventional techniques may be utilized to apply the various layers of the photoreceptor, including, for example, optional overcoat and undercoat layers, blocking layers, and including the charge generating layer of this invention.

Any suitable conventional electrophotographic charging, exposure, development, transfer, fixing and cleaning techniques may be utilize to form and develop electrostatic latent images on the imaging member of this invention. Thus, for example, conventional light lens or laser exposure systems may be used to form the electrostatic latent image. The resulting electrostatic latent image may be developed by suitable conventional development techniques such as magnetic brush, cascade, powder cloud, and the like.

This invention provides advantages over the charge generating layer binder materials previously used. The charge generating layer binder utilized in this invention is more economical to use and improved coating quality is obtained. For example, the binder materials of the present invention are available at a cost much lower than the previously used Makrolon and other PC-z materials. Furthermore, the charge generating layer binder utilized in this can be used at very high weight average molecular weights. This provides for greater latitude in adjusting the various process parameters of the coating process, which can increase throughput and efficiency in the imaging member production process. Still furthermore, this invention avoids the need to use environmentally unfriendly chlorinated solvents, such as methylene chloride.

In embodiments of the present invention, use of the improved binder material enables the production of imaging members where the charge generating layer is free of stress-induced defects which may be in the form of convection or Benard cells. The higher solution viscosity of the improved binder aids in the reduction of these coating defects. Furthermore, even when such cracks may be likely to form, their formation can be further reduced or eliminated by suitable control of the coating and drying processes, as will be apparent to those skilled in the art.

The present invention thus provides an improved imaging member, which can be produced at lower cost than previously available in the art, without sacrificing high quality standards. The imaging members of the present invention provide electrical operation results, such as in imaging processes, comparable to the known imaging members. Furthermore, such production can be conducted without the need for environmentally-unfriendly solvents.

Examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLES

Example 1

An electrophotographic imaging member is prepared by providing a 0.02 micrometer thick titanium layer coated on a polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with a ½ mil gap Bird applicator to the blocking layer a wet coating containing 0.5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer is allowed to dry for 5 minutes at 135° C. in a forced air oven. The resulting adhesive interface layer has a dry thickness of 0.065 micrometer.

The adhesive interface layer is thereafter coated with a photogenerating layer containing 40 percent by volume benzimidazole perylene (BzP), and 60 percent by volume APEC 9204, a homopolymer containing 100% bisphenol TMC available from Bayer AG. This photogenerating layer is prepared by introducing 0.45 grams APEC9204 and 44.6 grams of tetrahydrofuran into a 4 oz. amber bottle. To this solution is added 2.4 grams of BzP and 300 grams of ⅛ inch (3.2 millimeter) diameter stainless steel shot. This mixture is then placed on a ball mill for 72 to 96 hours. Subsequently, 2.25 grams of APEC9204 are dissolved in 46.1 grams of tetrahydrofuran, then added to this BzP slurry. This slurry is then placed on a shaker for 10 minutes. The resulting slurry is thereafter applied to the adhesive interface layer by using a ½ mil gap Bird applicator to form a coating layer having a wet thickness of 0.5 mil (12.7 micrometers). This photogenerating layer is dried at 135° C. for 5 minutes in a forced air oven to form a dry photogenerating layer having a thickness of 1.0 micrometers.

This coated imaging member web is simultaneously overcoated with a charge transport layer using a 3 mil gap Bird applicator. The charge transport layer is prepared by introducing into an amber glass bottle a weight ratio of 1:1

N,N'-diphenyl-N,N'-bis(3-methylphenyl)- 1,1'-biphenyl-4-4'-diamine and Makrolon 5705, a polycarbonate resin having a molecular weight of 50,000 to 100,000 available from Farbenfabriken Bayer A. G. The resulting mixture is dissolved to give a 15 percent by weight solid in 85 percent by weight methylene chloride. This solution is applied onto the photogenerator layer to form a coating which upon drying had a thickness of 24 micrometers.

The electrical data is presented in Table I below.

Example 2

An electrophotographic imaging member is prepared according to procedures of Example 1, except that APEC 9203 a copolymer containing 45% bisphenol A and 55% bisphenol TMC available from Bayer A G, is used as the binder for the charge generator layer. The imaging member is tested as in Example 1.

The electrical data is presented in Table 1 below.

Comparative Example

An electrophotographic imaging member is prepared according to the procedures of Example 1, except that PC-z 200 is used as the binder for the charge generator layer. The imaging member is tested as in Example 1.

The electrical data is presented in Table I below.

The xerographic properties of the photoconductive imaging samples prepared according to the above examples are evaluated with a xerographic testing scanner comprising a cylindrical aluminum drum having a diameter of 24.26 cm (9.55 inches). The test samples are taped onto the drum. When rotated, the drum carrying the samples produces a constant surface speed of 76.3 cm (30 inches) per second. A direct current pin corotron, exposure light, erase light, and five electrometer probes are mounted around the periphery of the mounted photoreceptor samples. The sample charging time is 33 milliseconds. The expose light has a 670 nm output and erase light was broad band white light (400–700 nm) output, each supplied by a 300 watt output Xenon arc lamp. The test samples are first rested in the dark for at least 60 minutes to ensure achievement of equilibrium with the testing conditions at 40 percent relative humidity and 21° C. Each sample is then negatively charged in the dark to a development potential of about 900 volts. The charge acceptance of each sample and its residual potential after discharge by front erase exposure to 400 ergs/cm$^2$ are recorded. Dark Decay is measured as a loss of Vddp after 0.66 seconds. The test procedure is repeated to determine the photo induced discharge characteristic (PIDC) of each sample by different light energies of up to 20 ergs/cm$^2$. The photodischarge is given as the ergs/cm$^2$ needed to discharge the photoreceptor from a Vddp 600 volts to 100 volts.

TABLE I

| Example | Binder | E600-100 (ergs/cm$^2$) | E600-300 (ergs/cm$^2$) | Dark Decay (V) | Vbg 3.8 ergs/cm$^2$ (V) | Vr (V) t = 0/t = 10k |
|---|---|---|---|---|---|---|
| Comp Ex | PC-z 200 | 7.9 | 4.05 | −81 | 314 | 16/11 |
| Ex. 1 | APEC 9204 | 8.67 | 4.52 | −57 | 341 | 16/10 |
| Ex. 2 | APEC 9203 | 8.22 | 4.16 | −66 | 320 | 18/12 |

As is apparent from the results in Table I, the use of APEC as a charge generator binder provides comparable electrical characteristics to the use of PC-z 200.

While this invention has been described in conjunction with specific embodiments described above, it is evident that many alternatives, modifications and variations will be apparent to those skilled in the art. Accordingly, the preferred embodiments of the invention, as set forth above, are intended to be illustrative not limiting. Various changes may be made without departing from the spirit and scope of the invention.

What is claimed is:

1. An electrophotographic imaging member, comprising:

a substrate;

a charge generator layer that comprises a polycarbonate binder of the following formula:

(I)

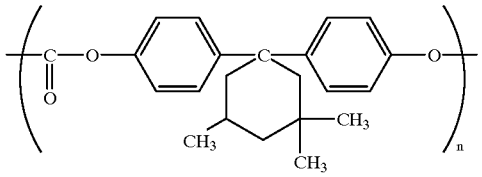

wherein n is 55 to 100 mole %, and $T_g$ is greater than 200° C.; and a charge transport layer that is separate from the charge generator layer.

2. The electrophotographic imaging member of claim 1, wherein n is 100 mole %, and Tg is about 245° C.

3. The electrophotographic imaging member of claim 1, further comprising benzimidazole perylene particles dispersed in the charge generator layer.

4. The electrophotographic imaging member of claim 1, wherein the polycarbonate binder has been solubilized in a solvent other than methylene chloride.

5. The electrophotographic imaging member of claim 1, wherein the polycarbonate binder has been solubilized in a solvent other than a chlorinated solvent.

6. The electrophotographic imaging member of claim 1, wherein the polycarbonate binder has been solubilized in tetrahydrofuran.

7. The electrophotographic imaging member of claim 1, wherein the polycarbonate binder has a weight average molecular weight of between 35,000 and 350,000.

8. An electrophotographic imaging member, comprising:

a substrate;

a charge generator layer that comprises a polycarbonate binder prepared by solubilizing the polycarbonate binder in a non-chlorinated solvent, the polycarbonate binder being of the following formula:

(I)

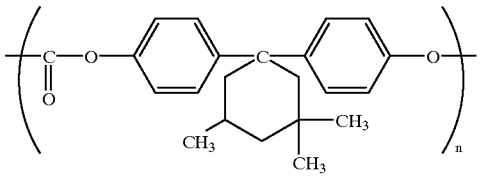

wherein n is 100 mole %, and $T_g$ is 245° C.; and a charge transport layer that is separate from the charge generator layer.

9. The electrophotographic imaging member of claim 1, wherein n is less than 100 mole % and wherein the remainder of the polycarbonate binder is bisphenol A.

10. The electrophotographic imaging member of claim 1, wherein the polycarbonate binder further comprises 0% to 45% bisphenol A.

11. A method of preparing the electrophotographic imaging member, comprising:

forming over a substrate, a charge generator layer that comprises a polycarbonate binder of the following formula:

(I)

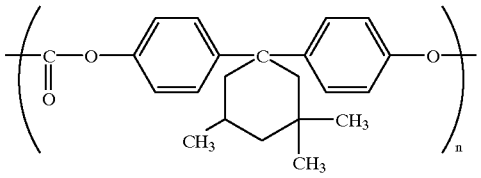

wherein n is 55 to 100 mole %, and $T_g$ is greater than 200° C.; and forming over the charge generator layer a charge transport layer that is separate from the charge generator layer.

12. The method of preparing an electrophotographic imaging member of claim 11, wherein n is 100 mole %, and Tg is 245° C.

13. The method of preparing an electrophotographic imaging member of claim 11, further comprising dispersing benzimidazole perylene particles within the charge generator layer.

14. The method of preparing an electrophotographic imaging member of claim 11, wherein the step of forming a generator layer comprises solubilizing the polycarbonate in a solvent other than methylene chloride.

15. The method of preparing an electrophotographic imaging member of claim 11, wherein the step of forming a generator layer comprises solubilizing the polycarbonate in a solvent other than a chlorinated solvent.

16. The method of preparing an electrophotographic imaging member of claim 11, wherein n is less than 100 mole % and wherein the remainder of the polycarbonate binder is bisphenol A.

17. The method of preparing an electrophotographic imaging member of claim 11, wherein the polycarbonate binder further comprises 0% to 45% bisphenol A.

18. An electrophotographic imaging member formed by the method of claim 11.

* * * * *